United States Patent [19]

Yang

[11] 4,024,821

[45] May 24, 1977

[54] UNIT TRAIN COAL CAR TENSION STRIPS TO PREVENT CAR BODY FROM TWIST

[75] Inventor: Tunghan Yang, Munster, Ind.

[73] Assignee: Pullman Incorporated, Chicago, Ill.

[22] Filed: Oct. 24, 1975

[21] Appl. No.: 625,606

[52] U.S. Cl. ..... 105/406 R; 52/149; 105/411; 296/28 M; 296/40

[51] Int. Cl.[2] ..... B61D 17/00

[58] Field of Search ..... 105/396, 402, 404, 406 R, 105/407, 411, 468; 296/28 M, 40; 52/149, 264

[56] References Cited

UNITED STATES PATENTS

| | | | |
|---|---|---|---|
| 1,073,663 | 9/1913 | Cavner | 105/411 |
| 1,267,364 | 5/1918 | Blest | 105/411 |
| 1,859,261 | 5/1932 | Mussey | 105/249 |

*Primary Examiner*—L. J. Paperner
*Assistant Examiner*—George F. Abraham
*Attorney, Agent, or Firm*—Richard J. Myers

[57] ABSTRACT

A gondola type railway car including a pair of laterally crossed elongated braces at each end of the car which couple the car corner caps to the car floor. Each brace extends downwardly and longitudinally inward and substantially across the car. The braces restrain lateral and longitudinal deflection of the car walls and thereby substantially reduce fatigue and fracture of the corner caps and walls. These braces not only effectively oppose the loads imposed upon the walls, but also do not obstruct the functionality of the car and do not materially encroach upon the usable space.

6 Claims, 9 Drawing Figures

FIG. 3
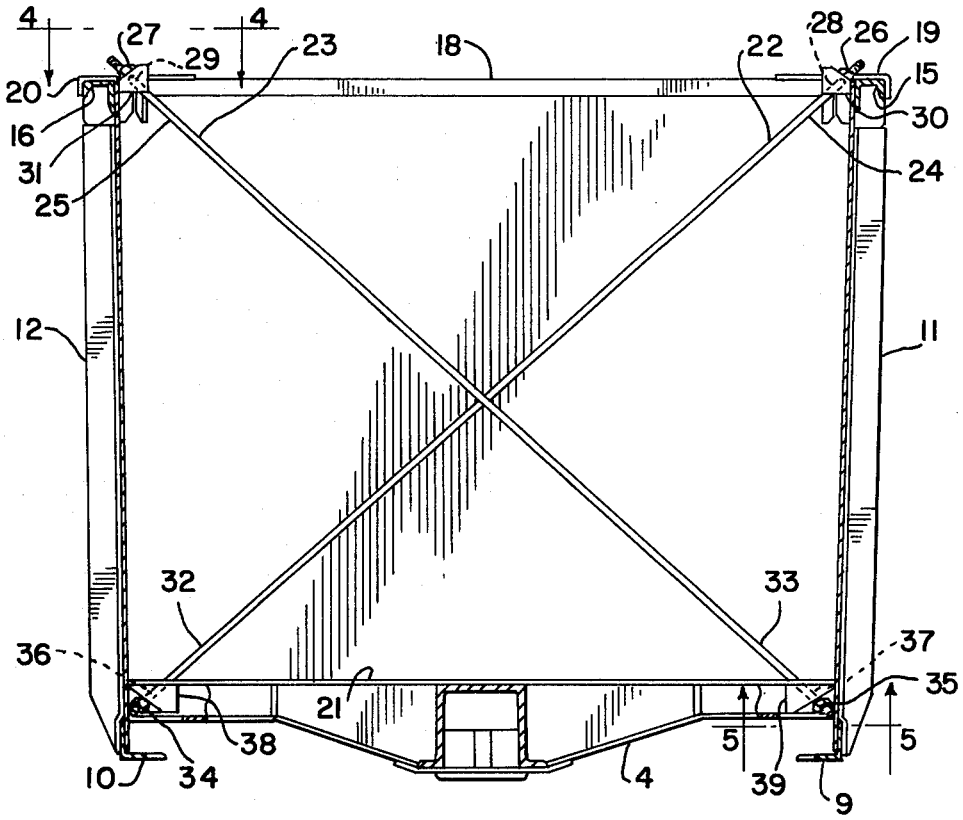
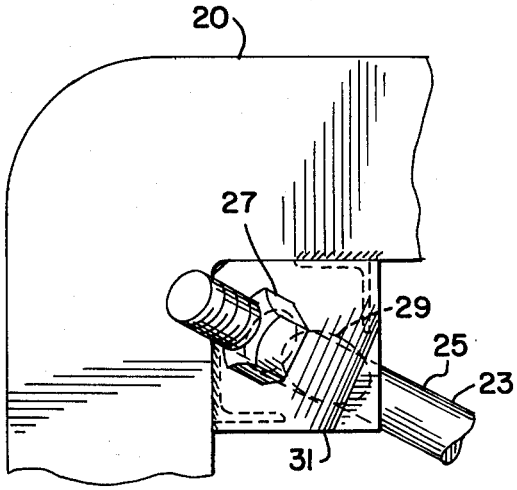
FIG. 4
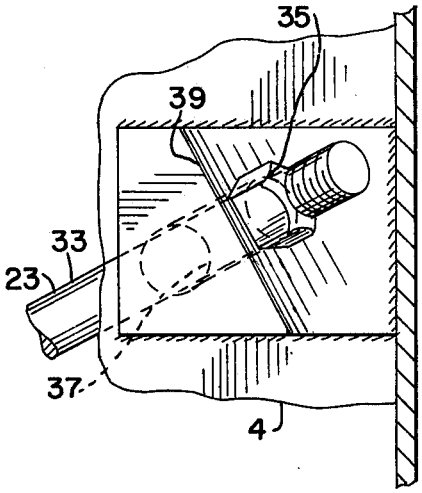
FIG. 5

UNIT TRAIN COAL CAR TENSION STRIPS TO PREVENT CAR BODY FROM TWIST

BACKGROUND OF THE INVENTION

1. Field of the Invention

This invention relates to gondola type railway cars having open top shell construction. Railway cars of this type are particularly suited to unit train operations and may be used for hauling woodchips, coal or other bulk material with the cars being readily adapted for rotary discharge.

2. Description of the Prior Art

As discussed in U.S. patent application Ser. No. 574,481, filed May 5, 1975, by Roy W. Miller and Jack E. Gutridge, now U.S. Pat. No. 3,964,399 issued June 22, 1976, which is incorporated by reference herein, railway gondola cars of a conventional design are provided with a car floor which is supported and rests upon the top of a center sill projecting outwardly from the ends of the car. The floor is carried on cross bearers which are connected at their inner ends to the webs of the center sill and extend outwardly from opposite sides thereof to the side sills. The side and end walls of the car are coupled at each of the upper corners of the car by an overlying corner cap.

Because gondolas are less rigid against torsion, they are therefore vulnerable to severe end-to-end torsional twisting to which other types of railway freight cars can more easily resist. Additionally, experience has shown that during rail use over rough or high speed tracks generally oscillatory end-to-end torsional loading on the gondola causes simultaneous lateral and longitudinal deflection of the upper portions of the car walls. The character and relationship of this deflection is illustrated in FIG. 9 which shows plan view outlines of a car having undeflected walls in solid lines and the upper portions of the walls of the same car illustratively deflected in phantom lines.

Attention is also directed to U.S. Pat. No. 789,854 which shows diagonal bracing extending normal to the sides of a vehicle. U.S. Pat. No. 1,262,301 shows cross-bracing parallel to the end wall of a car, and U.S. Pat. No. 922,969 shows a chain brace spanning the upper and lower ends of the side walls of a vehicle. None, however, solve the problem of rigidizing the car body by braces which bisect the corners and extend into the car and attach at their upper ends to the corners and at their lower ends to cross-members, such as bolsters which extend beneath the car body and thus effectively resisting destructive flexure hereinafter discussed.

Considering the above and the drawing, it can be seen that the oscillatory parallelogram motion of the upper portions of the car walls accentuates fatique loading and fracture of the car body and particularly the overlying corner caps.

SUMMARY OF THE INVENTION

The present invention discloses an improved gondola type railway car particularly suited for unit train operations wherein the car is readily adapted to rotary discharge.

The invention provides a pair of laterally crossed elongated braces at each end of a gondola car which couple the corner caps to the car floor. Each brace extends downwardly longitudinally inward and substantially laterally across the car therewithin. By this means, each brace restrains outward deflection of the car walls therefrom in both longitudinal and lateral directions. Thus, when acting together, each pair of the crossed braces will restrain deflection of the car walls in any direction. The invention also provides an adjustment means for each brace so that the braces may be secured to the car under tension to enhance the structural integrity of the coupling between the ends of the brace and the car body and reduce fatique and fracture of the car body.

It is therefore an object of the present invention to provide a bracing means for a gondola type railway car which restrains simultaneous longitudinal and lateral deflection of the car walls.

It is another object to provide a pair of laterally crossed elongated braces at each end of a gondola car coupling the upper portions of the car walls to the car floor wherein each brace extends downwardly and substantially laterally across and longitudinally inward of the car.

It is another object to provide a gondola car having braces of the foregoing character coupling the corner caps to the car floor.

It is another object to provide a gondola car having braces of the foregoing character coupling the upper portions of the car walls to the outer ends of the car bolster beams.

It is another object to provide an adjustment means for a brace of the foregoing character whereby the brace may be secured to the car under tension to reduce impact loading on the car body end members.

It is another object to provide a bracing means of the foregoing character which reduces the magnitude of lateral and longitudinal deflection of the upper corner portions of the car walls by a substantial margin.

These and other objects will become more apparent from reference to the following description, appended claims and attached drawings.

BRIEF DESCRIPTION OF THE DRAWINGS

FIG. 3 is a cross sectional view taken substantially along line 3—3 in FIG. 2;

FIG. 4 is an enlarged plan view taken substantially along line 4—4 in FIG. 3; and FIG. 5 is an enlarged sectional view taken substantially along line 5—5 in FIG. 3;

DESCRIPTION OF THE PREFERRED EMBODIMENT

Figure 1:
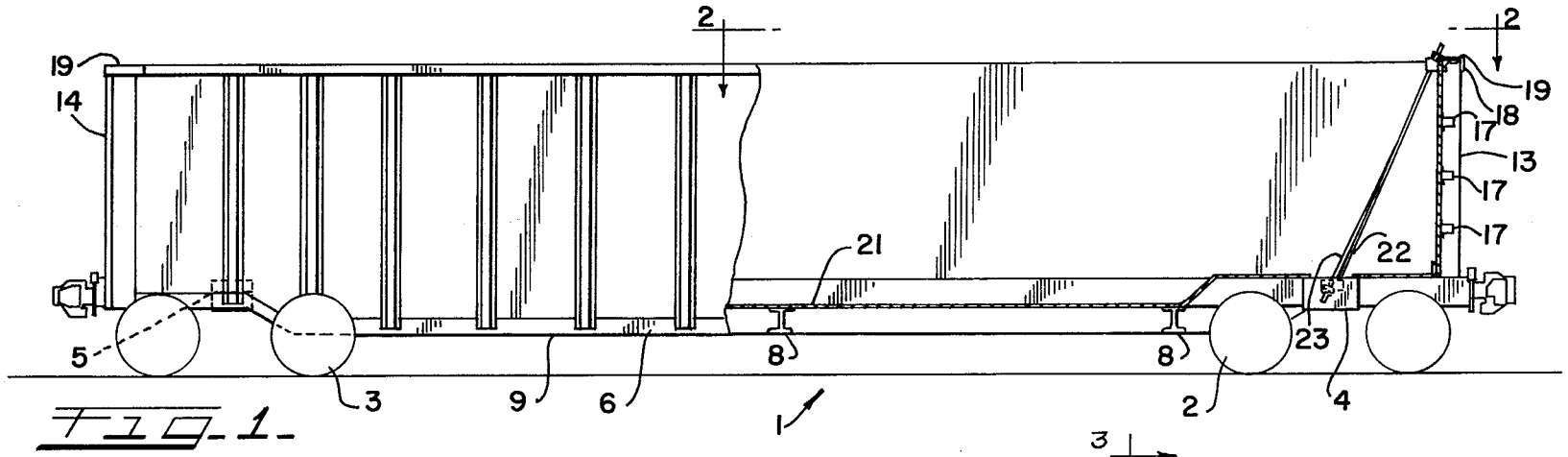
FIG. 1 is a side elevational view of a railway gondola car having part of its side wall cut-out to show the elongated braces.
Figure 2:
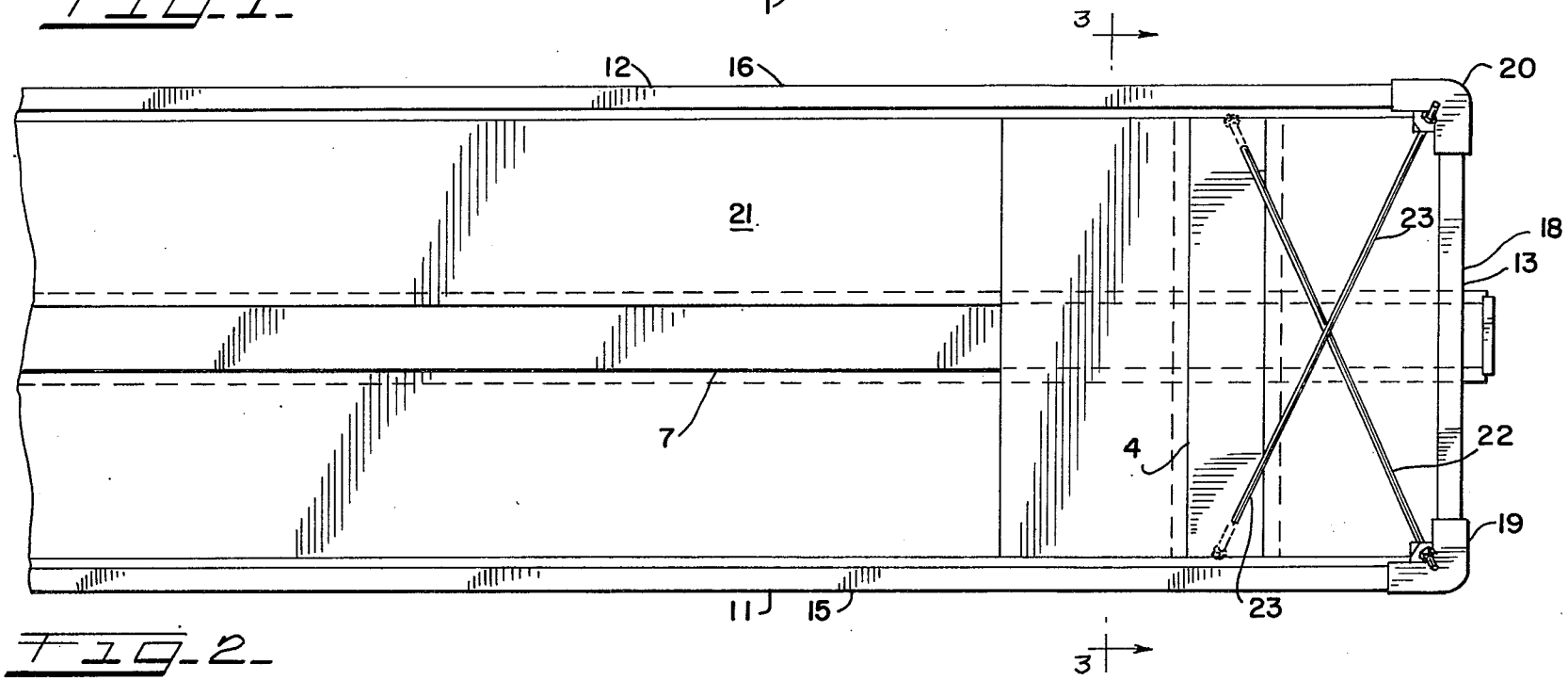
FIG. 2 is an enlarged partial plan view taken substantially along line 2—2 in FIG. 1.

Turning to the consideration of the drawings and particularly FIG. 1, there shown is a railway gondola car 1 supported on wheel trucks 2 and 3 through transverse bolster beams 4 and 5. The car 1 has an underframe 6 including an elongated center sill 7 hat-shaped in cross-section and a plurality of longitudinally spaced horizontal cross-bearers 8 which are connected at their ends to the opposite sides of the center sill 7 and extend outwardly therefrom to angle-shaped longitudinally extending side sills 9 and 10.

The gondola car 1 includes side walls 11 and 12 and end walls 13 and 14. The lower ends of the side walls 11 and 12 are suitably connected to side sills 9 and 10 and the upper ends of the walls 11 and 12 are connected to the upper side plates 15 and 16 longitudinally extending between the end walls 13 and 14. The end walls 13 and 14 are each rigidified by horizontally extending cross braces 17 and upper end plates 18, and the upper edges of the side walls 11 and 12 and end walls 13 and 14 are coupled together by overlying corner end capping members or caps 19 and 20 to rigidify the upper ends of the car walls. Additionally, floor plating 21 carried by center sill 7, bolster beams 4 and 5, and cross-bearers 8, and extending between the side walls 11 and 12, is provided to enclose the bottom of the car 1.

To restrain end-to-end torsional twisting and consequent structurally fatiguing lateral and longitudinal deflection of the car walls, the invention provides a pair of laterally crossed elongated braces 22 and 23 at each end of the car 1 in bisecting relation to the respective corners of the car. Braces 22, 23 couple the corner caps 19 and 20 to the opposite outer ends of the car bolster beams 4 and 5. More particularly and as most clearly shown in FIGS. 3–5 which illustrate the bracing at one end of the car which is typical of the bracing provided at both ends, each of the braces 22 and 23 are rigid elongated rod-like members which extend inwardly and diagonally downwardly across the car 1. The upper ends 24 and 25 of the braces 22 and 23 extend through apertures 28 and 29 in inwardly extending horizontal corner-spanning flanges 30 and 31 of the corner caps 19 and 20, are threadably secured by nuts 26 and 27 thereto, and the lower ends 32 and 33 of braces extend through apertures 36 and 37 and are threadably secured by bolts 34 and 35 to lugs 38 and 39 which are secured within the ends of the bolster beams 4 and 5 by welding or other well-known means. It will be understood that the seating areas of the flanges 30, 31 and lugs 38, 39 are normal to the axis of the respective bracing rods and that the nuts seat flat thereagainst.

Figure 6:
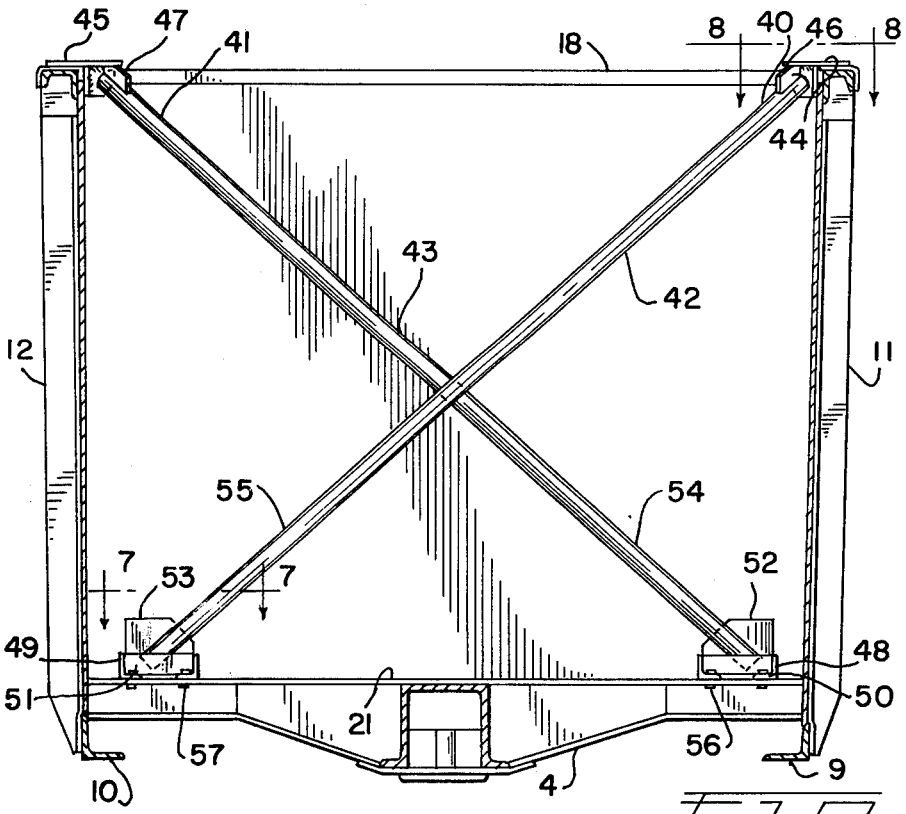
FIG. 6 is a cross sectional view similar to FIG. 3 but showing an alternative construction particularly in the means of securing the upper and lower ends of the braces.
Figure 9:
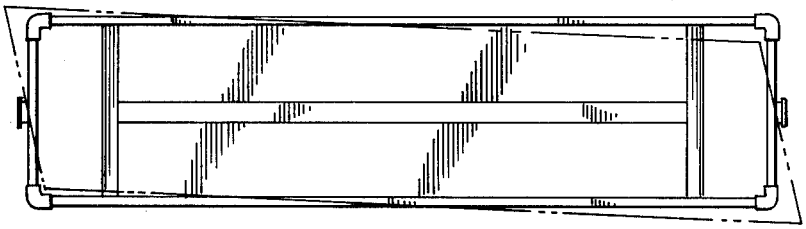
PRIOR ART FIG. 9
FIG. 9 is a plan view outline showing a prior art gondola car having undeflected walls in a solid lines and showing the walls of the same car deflected in phantom lines.
Figure 7:
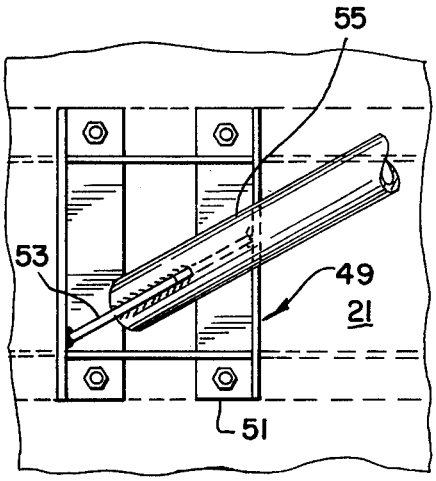
FIG. 7 is an enlarged plan view taken substantially along line 7—7 in FIG. 6.
Figure 8:
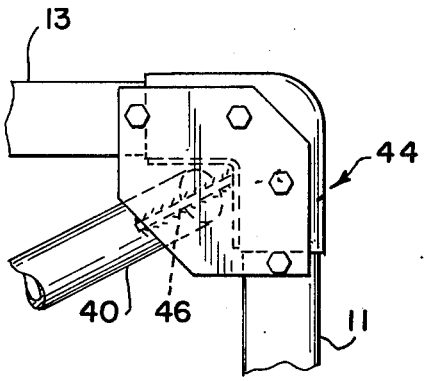
FIG. 8 is an enlarged plan view taken substantially along line 8—8 in FIG. 6.

FIGS. 6–8 show an alternative means of securing the upper and lower ends of laterally crossed braces of the foregoing character. As shown in FIG. 8, the upper ends 40 and 41 of braces 42 and 43 are secured to the corner cap weldments 44 and 45 overlying and coupling the end walls 13 and 14 and side walls 11 and 12 and having inwardly downwardly diagonal brace attachment flange portions or fillets 46 and 47 to which the braces 42 and 43 are secured by welding or other well-known means. Similarly, FIG. 7 discloses upstanding brackets 48 an 49 including horizontal plates 50 and 51 bolted by bolts 56 and 57 to the car floor 21 and vertically extending flanges or fillets 52 and 53 secured to the lower ends 54 and 55 of the braces 42 and 43 by welding or other well-known means.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is

1. In a railway car supported on spaced car trucks and including a body having sides and end walls and a transverse bolster beam at each end of the car connected to said sides and spaced longitudinally inward of an associated end wall, an improved car wall bracing means, comprising;

a pair of laterally crossed elongated braces provided for each end wall, each of said braces extending diagonally downward and longitudinally inward and substantially laterally across the car between one of said end walls and said associated bolster beam, and each of said braces having an upper attachment portion securing said brace to an upper edge portion of its associated end wall, and a lower attachment portion securing said brace to its associated bolster beam on the opposite side of the car, said body having four upper corners defined by the side and end walls of the car, and each of said corners having an overlying cap coupling adjacent side and end walls and including an inwardly extending cap flange couplable with the upper attachment portion of said elongated brace, said cap flange having a downwardly longitudinally inward and laterally diagonal aperture therethrough, and said upper brace attachment portion extending through said cap aperture.

2. In a railway car supported on spaced car trucks and including a body having sides and end walls and a transverse bolster beam at each end of the car connected to said sides and spaced longitudinally inward of an associated end wall, an improved car wall bracing means, comprising;

a pair of laterally crossed elongated braces provided for each end wall, each of said braces extending diagonally downward and longitudinally inward and substantially laterally across the car between one of said end walls and said associated bolster beam, and each of said braces having an upper attachment portion securing said brace to an upper edge portion of its associated end wall, and a lower attachment portion securing said brace to its associated bolster beam on the opposite side of the car, and said bolster beam including outer end portions having an attachment lug secured therein extending normal to the associated brace and having an aperture extending through said lug and associated outer end portion, and said lower brace attachment portion extending through said lug aperture.

3. The invention according to claim 2, and means integrally securing said upper and lower attachment portions to said braces.

4. In a railway car comprising a body having interconnected longitudinal side walls and transverse end walls defining corners therebetween, improved side and end wall bracing means comprising:

a pair of laterally crossed elongated braces within the car body for each end wall and portions of the side wall thereadjacent and lying in a plane inclined relative to the end wall in upwardly converging relation thereto lengthwise of the car, said braces having upper ends connected to adjacent walls proximate to their upper ends adjacent the respective corners and extending longitudinally and laterally of each of the related walls to the lower edge of the side wall on the opposite side of the car, and means connecting the lower ends of each of said braces to adjacent portions of said body.

5. The invention according to claim 4, and said car having bolsters adjacent to each end thereof, and said connecting means of the lower ends of the braces being made to the respective bolsters.

6. The invention according to claim 4, and connector means spanning each corner at the upper ends of the adjacent walls, and said connections of the upper ends of the braces with said walls being through said connector means.

* * * * *